US005911469A

United States Patent [19]

Young

[11] Patent Number: 5,911,469

[45] Date of Patent: Jun. 15, 1999

[54] FOLDING ADIRONDACK CHAIR

[76] Inventor: Charles L. Young, 2149 Frisco Dr., Davenport, Iowa 52804-2360

[21] Appl. No.: 08/992,722

[22] Filed: Dec. 17, 1997

[51] Int. Cl.[6] ..... A47C 4/00

[52] U.S. Cl. ..... 297/31; 297/35; 297/39

[58] Field of Search ..... 297/31, 39, 40, 297/35

[56] References Cited

U.S. PATENT DOCUMENTS

| | | | |
|---|---|---|---|
| D. 360,082 | 7/1995 | Tseng . | |
| D. 371,466 | 7/1996 | Boisson . | |
| 1,162,598 | 11/1915 | Gallup | 297/39 |
| 2,385,072 | 9/1945 | Gray | 297/35 X |
| 2,467,909 | 4/1949 | Rechler | 297/39 X |
| 2,547,897 | 4/1951 | Wozniak | 297/31 |
| 2,650,652 | 9/1953 | Watson | 297/31 |
| 4,635,998 | 1/1987 | Hickey . | |
| 4,707,023 | 11/1987 | Hickey . | |
| 4,976,492 | 12/1990 | Ziegler . | |
| 5,120,071 | 6/1992 | Thibault et al. . | |
| 5,282,664 | 2/1994 | Tseng . | |
| 5,364,112 | 11/1994 | Jackson . | |

FOREIGN PATENT DOCUMENTS

| | | | |
|---|---|---|---|
| 843005 | 7/1952 | Germany | 297/39 |

*Primary Examiner*—Peter M. Cuomo
*Assistant Examiner*—David E. Allred
*Attorney, Agent, or Firm*—Richard L. Miller, P.E.

[57] ABSTRACT

A folding adirondack chair that has a collapsed position and an in-use position. The chair includes a combined seat bottom and rear leg assembly that is pivotally mounted to the combined seat bottom and rear leg assembly, a front leg assembly that is pivotally mounted to the combined seat bottom and rear leg assembly, an arm rest assembly that is pivotally mounted to both the seat back assembly and the front leg assembly, and a stop assembly that maintains the chair in the in-use position. The stop assembly comprises a pair of pivot blocks that are fixedly attached to the pair of rails of the combined seat bottom and rear leg assembly and pivotally connected to the seat back assembly, and a pair of stop blocks that are fixedly attached to the pair of rails of the combined seat bottom and rear leg assembly and extend forwardly from fixed abutment with the pair of pivot blocks to abutment with the pair of front legs of the front leg assembly when the folding adirondack chair is in the in-use position so as to prevent pivoting of the pair of front legs of the front leg assembly, which by way of the elongated ribs of the arm rest assembly, prevents pivoting of the seat back assembly and maintains the folding adirondack chair in the in-use position.

7 Claims, 2 Drawing Sheets

36
14
10
3
44
18
18
44
46
48
50
2
42
51
46
30
54
13
20
24
52
50
28
56
16
26
20
34
28
12
32
32
16

36
10
40
14
46
38
46
44
18
18
42
44
56
30
20
28
28
12
16
32
24
32
20
16

36
10
40
14
44
18
16
46
46
48
12
30
38
34
13
54
28
42
56
20
52
13
16
32
32
20
24
26
26

58
14
60
12
32
62

FOLDING ADIRONDACK CHAIR

BACKGROUND OF THE INVENTION

1. Field of the Invention

The present invention relates to a folding chair. More particularly, the present invention relates to a folding adirondack chair.

2. Description of the Prior Art

Numerous innovations for folding chairs have been provided in the prior art that will be described. Even though these innovations may be suitable for the specific individual purposes to which they address, however, they differ from the present invention.

FOR EXAMPLE, U.S. Pat. No. 4,635,998 to Hickey teaches a fold-away chair capable of being pivoted from a position of use to a fully collapsed position. The chair has a combined seat bottom and a rear leg assembly, a seat back assembly, a pair of front legs, a pair of arm rests, and levers to facilitate folding. The combined seat bottom and rear leg assembly comprises a pair of laterally spaced side rails having a transverse load-bearing member at the front ends. When the chair is in its position of use, this load-bearing member bears upon a transverse load-bearing member connecting the front legs. Pins connect the legs to the forward ends of the side rails to lock the chair in its position of use. When these pins are removed, the chair may be folded to collapsed position.

ANOTHER EXAMPLE, U.S. Pat. No. 4,707,023 to Hickey teaches a fold-away chair capable of being pivoted from a position of use to a fully collapsed position. The chair has a combined seat bottom and a rear leg assembly, a seat back assembly, a pair of front legs, a pair of arm rests, and a sliding pivot assembly to facilitate folding. The combined seat bottom and rear leg assembly comprises a pair of laterally spaced side rails having a transverse load-bearing member at the front ends. When the chair is in its position of use, this load-bearing member bears upon a transverse load-bearing member connecting the front legs. Pins connect the legs to the forward ends of the side rails to lock the chair in its position of use. When these pins are removed, the chair may be folded to collapsed position.

STILL ANOTHER EXAMPLE, U.S. Pat. No. 4,976,492 to Ziegler teaches a foldable outdoor chair movable from a position of use to a collapsed position. The chair has a combined seat bottom and rear leg assembly including a seat bottom and laterally spaced rails, a seat back assembly including a seat back, a front leg assembly including a pair of laterally-spaced front legs, and a pair of arm rests. The outdoor chair also includes a lever assembly to facilitate folding which includes a pair of levers. Each lever is pivotally connected at a first pivot point to the seat back assembly below the seat bottom and is also pivotally connected at a second pivot point to one of the side rails below the center axis of the side rail. The chair is foldable when an upward force is applied to the seat back assembly to disengage the seat back from the side rails and subsequently a forward force is applied to the seat back such that a clockwise rotation is imparted to the first pivot point whereby the chair is moved to an intermediate position. The chair is then moved to its collapsed position when a downward force is applied to the seat back such that the levers are pivoted counterclockwise causing the seat bottom and leg assembly, seat back assembly, front leg assembly and pair of arm rest to be in a substantially horizontal orientation generally parallel to one another.

YET ANOTHER EXAMPLE, U.S. Pat. No. 5,120,071 to Thibault et al. teaches an Adirondack-type chair for therapeutic use with frail, older adults having a back support including six slats in a curved plane to support the lateral block muscles of the user on two medial slats and allowing the fragile spine of the user to be free from pressure which would be encountered by a central slat of a five-slat configuration. The curved plane of the back support fellows the natural curvature of the trunk of the body to provide equal distribution of pressure along the back. Wheels are provided at the bottom of the chair for user mobility. A handle located at the top of the back support provides a grasp for both hands of an assistant pushing the chair. In addition, a footrest located above the rear wheels of the chair allows for downward pressure to be exerted by a foot of the assistant, while pulling rearwardly by the handles at the top of the chair, to elevate the front end of the chair. The chair is tilted rearwardly for easy movement over door sills and other obstacles. A rearmost edge of the bottom frame portion of the chair is spaced so as to provide a stop against over-inclination of the chair. The chair is thereby permitted to tilt to a safe angle (preferably a maximum of approximately 30 degrees) so as to maintain the stability of the chair and the safety of its occupant.

FINALLY, STILL YET ANOTHER EXAMPLE, U.S. Pat. No. 5,282,664 to Tseng teaches a lawn chair that includes a seat frame assembly which has a seat frame and a rear leg frame, a backrest frame connected pivotally to the rear end portion of the seat frame at the lower end portion thereof, two spaced arm supporting frames provided on two sides of the backrest frame, two elongated positioning members secured to the rear end portions of the arm supporting frames, and two positioning studs extending outwardly from the two sides of the backrest frame. Each of the arm supporting frames has an intermediate portion connected pivotally to the seat frame, a front leg portion extending downwardly and forwardly from the intermediate portion, and an armrest portion extending upwardly and rearwardly from the intermediate portion. Each positioning member has an access hole and a longitudinal slot communicating with the access hole and having a horizontal row of upwardly extending positioning portions. Each of the studs engages a selected one of the positioning portions of the longitudinal slot and has a neck that is sized to prevent removal thereof from the longitudinal slot and to be slidable from the longitudinal slot into the access hole, and an enlarged head that is sized to be extensible through the access hole when the corresponding neck is moved to the same.

It is apparent that numerous innovations for folding chairs have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a folding adirondack chair that avoids the disadvantages of the prior art.

ANOTHER OBJECT of the present invention is to provide a folding adirondack chair that is simple and inexpensive to manufacture.

STILL ANOTHER OBJECT of the present invention is to provide folding adirondack chair that is simple to use.

BRIEFLY STATED, YET ANOTHER OBJECT of the present invention is to provide a folding adirondack chair that has a collapsed position and an in-use position. The chair includes a combined seat bottom and rear leg assembly that is pivotally mounted to the combined seat bottom and rear leg assembly, a front leg assembly that is pivotally mounted to the combined seat bottom and rear leg assembly, an arm rest assembly that is pivotally mounted to both the seat back assembly and the front leg assembly, and a stop assembly that maintains the chair in the in-use position. The stop assembly comprises a pair of pivot blocks that are fixedly attached to the pair of rails of the combined seat bottom and rear leg assembly and pivotally connected to the seat back assembly, and a pair of stop blocks that are fixedly attached to the pair of rails of the combined seat bottom and rear leg assembly and extend forwardly from fixed abutment with the pair of pivot blocks to abutment with the pair of front legs of the front leg assembly when the folding adirondack chair is in the in-use position so as to prevent pivoting of the pair of front legs of the front leg assembly, which by way of the elongated ribs of the arm rest assembly, prevents pivoting of the seat back assembly and maintains the folding adirondack chair in the in-use position.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
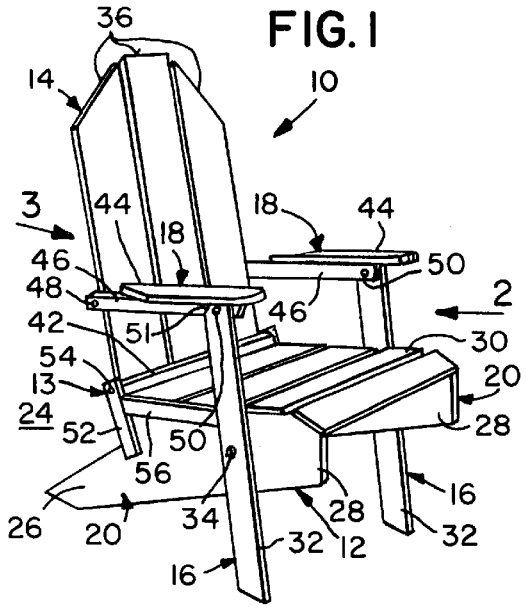
FIG. 1 is a diagrammatic three-quarter front perspective view of the present invention in the use position.

10 folding adirondack chair of the present invention
12 combined seat bottom and rear leg assembly
14 seat back assembly
16 front leg assembly
17 stop assembly
18 arm rest assembly
20 pair of rails of combined seat bottom and rear leg assembly 12
24 horizontal surface
26 rear leg portions of pair of rails 20 of combined seat bottom and rear leg assembly 12
28 front seat bottom portions of pair of rails 20 of combined seat bottom and rear leg assembly 12
30 plurality of slats 30 of combined seat bottom and rear leg assembly 12
32 pair of front legs of front leg assembly 16
34 pivots of front leg assembly 16
36 plurality of slats of seat back assembly 14
38 intermediate transverse bar of seat back assembly 14
40 upper transverse bar of seat back assembly 14
42 lower transverse bar of seat back assembly 14
44 pair of arm rests of arm rest assembly 18
46 pair of elongated ribs of arm rest assembly 18
48 rear aligned transverse pins of arm rest assembly 18
50 front aligned transverse pins of arm rest assembly 18
51 slants formed upper ends of pair of front legs of the front leg assembly 16
52 pair of pivot blocks of stop assembly 13
54 rear aligned transverse pins of stop assembly 13
56 pair of stop blocks of stop assembly 13
58 hand
60 other hand
62 foot

DETAILED DESCRIPTION OF THE PREFERRED EMBODIMENT

Figure 2:
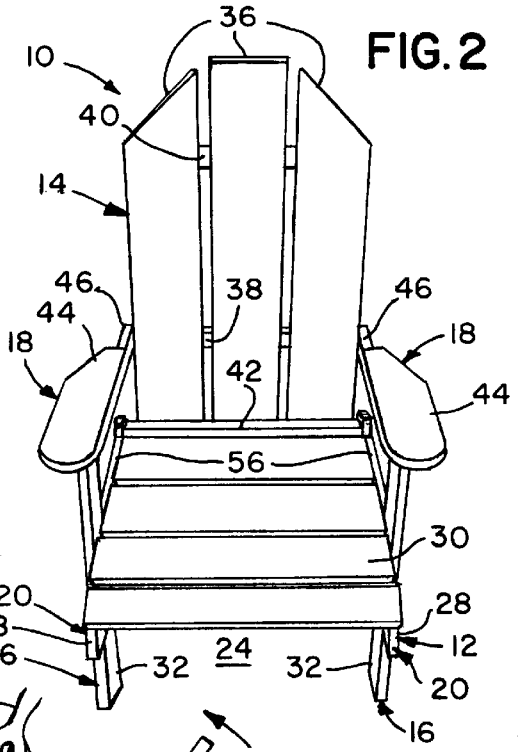
FIG. 2 is a diagrammatic front perspective view taken generally in the direction of arrow 2 in FIG. 1.
Figure 3:
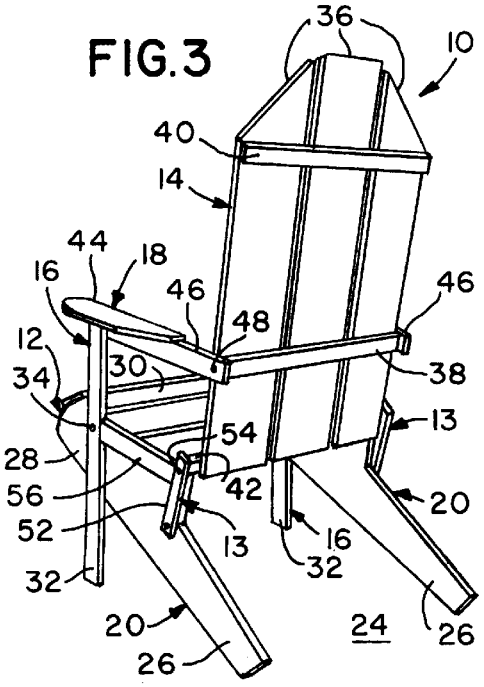
FIG. 3 is a diagrammatic three-quarter rear perspective view taken generally in the direction of arrow 3 in FIG. 1.

Referring now to the figures in which like numerals indicate like parts, and particularly to FIGS. 1–3, the folding adirondack chair of the present invention is shown generally at 10.

The configuration of the folding adirondack chair can best be seen in FIGS. 1–3, and as such will be discussed with reference thereto.

The folding adirondack chair has a collapsed position and an in-use position and comprises a combined seat bottom and rear leg assembly 12, a seat back assembly 14 that is pivotally mounted to the combined seat bottom and rear leg assembly 12, a front leg assembly 16 that is pivotally mounted to the combined seat bottom and rear leg assembly 12, a stop assembly 17 for maintaining said folding adirondack chair in the in-use position and is fixedly attached to the combined seat bottom and rear leg assembly 12 and pivotally mounted to the seat back assembly 14, and an arm rest assembly 18 that is pivotally mounted to both the seat back assembly 14 and the front leg assembly 16.

The combined seat bottom and rear leg assembly 12 comprises a pair of rails 20 that are laterally spaced apart, parallel, and are flat board-like members. When the folding adirondack chair 10 is supported on a horizontal surface 24 and in the in-use position, the pair of rails 20 are disposed in vertical planes and are inclined downwardly from their front ends to their back ends where they contact the horizontal surface 24.

The pair of rails 20 of the combined seat bottom and rear leg assembly 12 have rear leg portions 26 which extend from the rear ends to about midway of the pair of rails 20 of the combined seat bottom and rear leg assembly 12, and front seat bottom portions 28 which extend from about the midway to the front ends of the pair of rails 20 of the combined seat bottom and rear leg assembly 12.

The combined seat bottom and rear leg assembly 12 further comprises a plurality of slats 30 that are transversely spaced-apart, and are secured to the front seat bottom portions 28 of the pair of rails 20 of the combined seat bottom and rear leg assembly 12, at their upper edges, and connect the pair of rails 20 of the combined seat bottom and rear leg assembly 12 together and provide a supporting seat for a user.

The front leg assembly 16 comprises a pair of front legs 32 that are laterally spaced-apart and parallel. The pair of front legs 32 of the front leg assembly 16 are disposed vertically when the folding adirondack chair 10 is supported on the horizontal surface 24 in its position of use.

The front leg assembly 16 further comprises pivots 34, provided by nut and bolt assemblies, that connect the pair of front legs 32 of the front leg assembly 16, near their midpoints, to the front ends of the front seat bottom portions 28 of the pair of rails 20 of the combined seat bottom and rear leg assembly 12. The pivots 34 of the front leg assembly 16 extend transversely of the folding adirondack chair 10 and are disposed on a common horizontal axis.

The seat back assembly 14 extends upwardly and rearwardly when the folding adirondack chair 10 is on the horizontal surface and in the in-use position. The seat back assembly 14 comprises a plurality of slats 36 that are longitudinally-oriented and laterally spaced-apart and connected, on their backs, near their midpoints, by an intermediate transverse bar 38, and on their backs, near their upper ends, by an upper transverse bar 40. The plurality of slats 36 of the seat back assembly 14 are also connected, on their fronts, near their lower ends, by a lower transverse bar 42.

The arm rest assembly 18 comprises a pair of arm rests 44 that are in the form of elongated and flat board members which extend parallel to one another and, in the position of use of the folding adirondack chair 10 when supported on the horizontal surface 24, extend generally horizontally or perhaps with a slight downward and rearward slope.

The arm rest assembly 18 further comprises a pair of elongated ribs 46 that extend lengthwise of the pair of arm rests 44 of the arm rest assembly 18, and are secured to their undersides.

The elongated ribs 46 of the arm rest assembly 18 are pivotally connected, at their rear ends, by means of rear aligned transverse pins 48, to the intermediate transverse bar 38 of the seat back assembly 14, at its ends.

The elongated ribs 46 of the arm rest assembly 18 are pivotally connected, at their front ends, by means of front aligned transverse pins 50, to the pair of front legs 32 of the front leg assembly 16, at their upper ends.

The upper ends of the pair of front legs 32 of the front leg assembly 16, at their rears, are formed as slants 51 that slant forwardly and upwardly when the folding adirondack chair 12 is on the horizontal surface 24 and in the in-use position.

The stop assembly 13 comprises a pair of pivot blocks 52 that are parallel and fixedly attached, at their lower ends, to the pair of rails 20 of the combined seat bottom and rear leg assembly 12, at about their midpoints, and pivotally connected, at their upper ends, by means of rear aligned transverse pins 54, to the lower transverse bar 42 of the seat back assembly 14, at its ends.

The pair of pivot blocks 52 of the stop assembly 13 extend upwardly and rearwardly when the folding adirondack chair 10 is on the horizontal surface 24, and in the in-use position.

The stop assembly 13 further comprises a pair of stop blocks 56 that are parallel and fixedly attached, along their lengths, to the pair of rails 20 of the combined seat bottom and rear leg assembly 12, at their upper edges, and extend forwardly from fixed abutment with the pair of pivot blocks 52 of the stop assembly 13 to abutment with the pair of front legs 32 of the front leg assembly 16 when the folding adirondack chair 10 is on the horizontal surface 24 and in the in-use position so as to prevent pivoting of the pair of front legs 32 of the front leg assembly 16, which by way of the elongated ribs 46 of the arm rest assembly 18, prevent pivoting of the seat back assembly 14 and maintain the folding adirondack chair 10 in the in-use position, with the pair of pivot blocks 52 of the stop assembly 13 absorbing the load on the pair of stop blocks 56 of the stop assembly 13 transferred from the pair of front legs 32 of the front leg assembly 16.

The manner of folding the folding adirondack chair 10 from its in-use position to its collapsed position can best be seen in FIGS. 4–7, and as such will be discussed with reference thereto.

Figure 4:
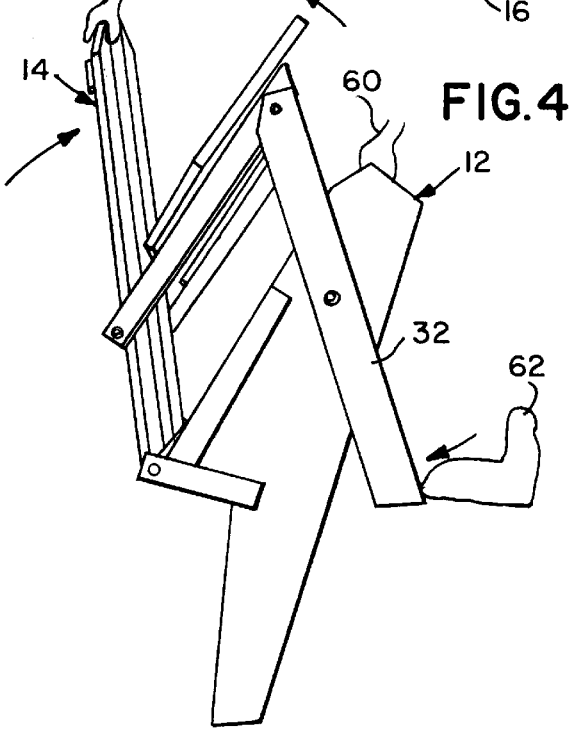
FIG. 4 is a diagrammatic side elevational view of the present invention in the partially folded position.

STEP 1: As shown in FIG. 4, grasp the seat back assembly 14, at its upper portion, with a hand 58.

STEP 2: As shown in FIG. 4, grasp the combined seat bottom and rear leg assembly 12, at its front, with the other hand 60.

STEP 3: As shown in FIG. 4, pull the seat back assembly 14 inwardly.

STEP 4: As shown in FIG. 4, simultaneously pull the combined seat bottom and rear leg assembly 12 upwardly.

STEP 5: As shown in FIG. 4, simultaneously push one leg of the pair of front legs 32 of the front leg assembly 16 inwardly with a foot 62.

Figure 5:
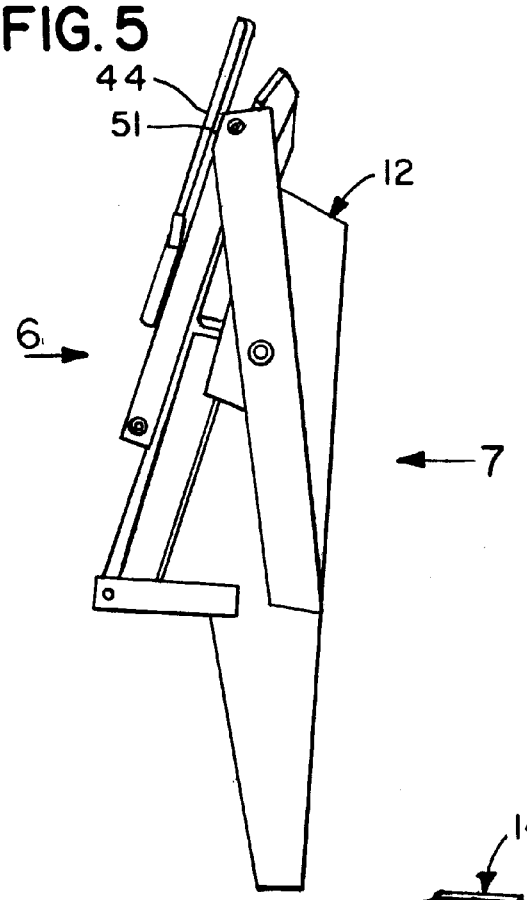
FIG. 5 is a diagrammatic side elevational view of the present invention in the fully folded position.
Figure 6:
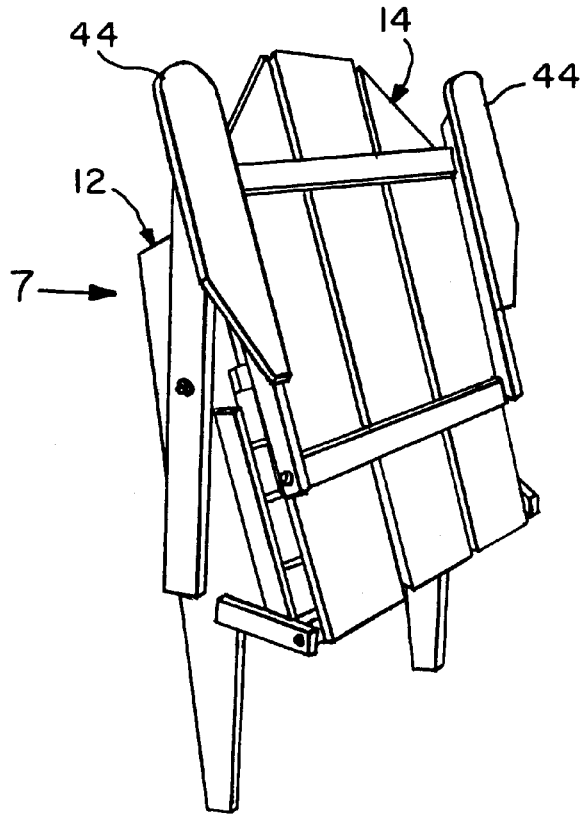
FIG. 6 is a diagrammatic three-quarter rear perspective view taken generally in direction of arrow 6 in FIG. 5.
Figure 7:
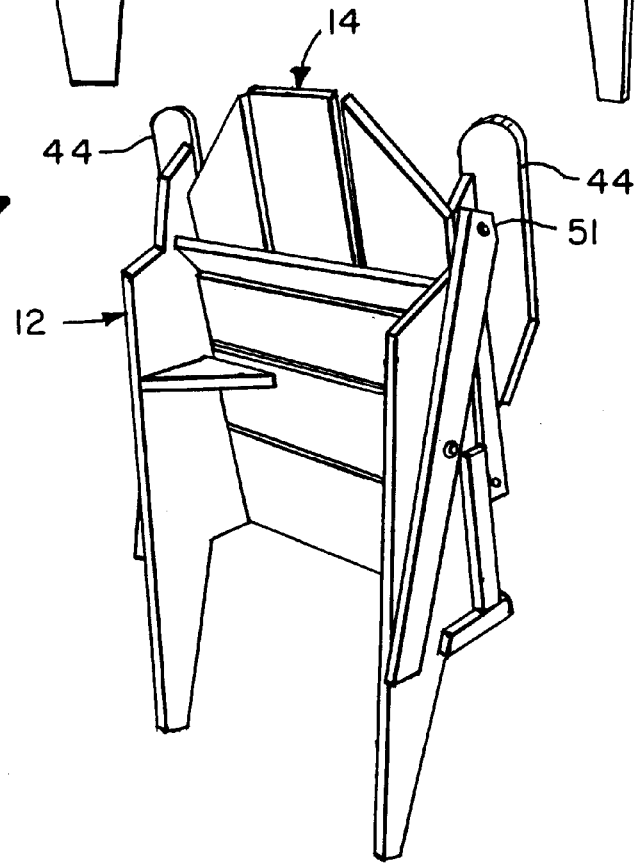
FIG. 7 is a diagrammatic three-quarter front perspective view taken generally in direction of arrow 7 in FIGS. 5 and 6.

STEP: 2: As shown in FIGS. 5–7, continue to draw the seat back assembly and the combined seat bottom and rear leg assembly 12 together, until the slants 51 of the pair of front legs 32 of the front leg assembly 16 contact the pair of arm rests 44 of the arm rest assembly 18, at their undersides.

It will be understood that each of the elements described above, or two or more together, may also find a useful application in other types of constructions differing from the types described above.

While the invention has been illustrated and described as embodied in a folding adirondack chair, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A folding adirondack chair having a collapsed position and an in-use position, comprising:

a) a combined seat bottom and rear leg assembly; said combined seat bottom and rear leg assembly comprising a pair of rails being laterally spaced apart, parallel, and flat members and being disposed in vertical planes and are inclined downwardly from their front ends to their back ends where they contact a horizontal surface when said chair is in said in-use position; said pair of rails of said combined seat bottom and rear leg assembly having midpoints, rear leg portions extending from their rear ends to substantially midway of said pair of rails of said combined seat bottom and rear leg assembly, and front seat bottom portions extending from substantially their midway points to said front ends of said pair of rails of said combined seat bottom and rear leg assembly;

b) a seat back assembly pivotally mounted to said combined seat bottom and rear leg assembly; said seat back assembly extending upwardly and rearwardly when said folding adirondack chair is on a horizontal surface and in said in-use position; said seat back assembly comprising a plurality of slats being laterally spaced-apart and connected to each other, on their backs, at their midpoints, by an intermediate transverse bar, and on their backs, at their upper ends, by an upper transverse bar; said plurality of slats of said seat back assembly being also connected, on their fronts, at their lower ends, by a lower transverse bar having ends;

c) a front leg assembly pivotally mounted to said combined seat bottom and rear leg assembly; said front leg assembly comprising a pair of front legs being laterally spaced-apart and parallel and disposed vertically when said folding adirondack chair is supported on the horizontal surface in its in-use position;

d) an arm rest assembly pivotally mounted to both said seat back assembly and said front leg assembly; said arm rest assembly comprising a pair of arm rests being in the form of elongated and flat board members extending parallel to one another, and in said position of use of said folding adirondack chair when supported on a horizontal surface, extending one of generally horizontally and with a slight downward and rearward slope; said arm rest assembly further comprising a pair of elongated ribs extending lengthwise of said pair of arm rests of said arm rest assembly, and being secured to their undersides; and e) a stop assembly comprising a pair of pivot blocks being i fixedly attached, at their lower ends, to said pair of rails of said combined seat bottom and rear leg assembly, at substantially said midpoints of said pair of rails of said combined seat bottom and rear leg assembly, and pivotally connected, at their upper ends, by means of rear aligned transverse pins, to said ends of said lower transverse bar of said seat back assembly; said pair of pivot blocks of said stop assembly extending upwardly and rearwardly when said folding adirondack chair is on a horizontal surface and in said in-use position; said stop assembly further comprising a pair of stop blocks being parallel to each other and fixedly attached, along their lengths, to said pair of rails of said combined seat bottom and rear leg assembly, at their upper edges, and extending forwardly from fixed abutment with said pair of pivot blocks of said stop assembly to abutment with said pair of front legs of said front leg assembly when said folding adirondack chair is on a horizontal surface and in said in-use position so as to prevent pivoting of said pair of front legs of said front leg assembly, which by way of said elongated ribs of said arm rest assembly, prevent pivoting of said seat back assembly and maintain said folding adirondack chair in said in-use position, with said pair of pivot blocks of said stop assembly absorbing load transferred from said pair of front legs of said front leg assembly to said pair of stop blocks of said stop assembly.

2. The chair as defined in claim 1; further comprising a stop assembly for maintaining said chair in said in-use position and being fixedly attached to said combined seat bottom and rear leg assembly and pivotally mounted to said seat back assembly.

3. The chair as defined in claim 1, wherein said combined seat bottom and rear leg assembly further comprises a plurality of slats that extend transversely are spaced-apart from each other, and are secured to said front seat bottom portions of said pair of rails of said combined seat bottom and rear leg assembly, at their upper edges, and connect said pair of rails of said combined seat bottom and rear leg assembly together and provide a supporting seat for a user.

4. The chair as defined in claim 1, wherein said front leg assembly further comprises pivots, provided by nut and bolt assemblies, that connect said pair of front legs of said front leg assembly, substantially at their midpoints, to said front ends of said front seat bottom portions of said pair of rails of said combined seat bottom and rear leg assembly; said pivots of said front leg assembly extend transversely of said folding adirondack chair and are disposed on a common horizontal axis.

5. The chair as defined in claim 4, wherein said elongated ribs of said arm rest assembly are pivotally connected, at their rear ends, by means of rear aligned transverse pins, to said intermediate transverse bar of said seat back assembly, at its ends.

6. The chair as defined in claim 4, wherein said elongated ribs of said arm rest assembly are pivotally connected, at their front ends, by means of front aligned transverse pins, to said pair of front legs of said front leg assembly, at their upper ends.

7. The chair as defined in claim 1, wherein said upper ends of said pair of front legs of said front leg assembly, at their rears, are formed as slants that slant forwardly and upwardly when said folding adirondack chair is on a horizontal surface and in said in-use position.

* * * * *